US005158205A

United States Patent [19]

Bodziak et al.

[11] Patent Number: 5,158,205

[45] Date of Patent: Oct. 27, 1992

[54] DISPENSER FOR A SMALL STACK OF NOTE PAPER

[75] Inventors: Douglas P. Bodziak, Lake Elmo; David C. Windorski, Woodbury, both of Minn.; June M. Armbruster, River Falls, Wis.; Michel Bourdin, Beauchamp, France

[73] Assignee: Minnesota Mining and Manufacturing Company, St. Paul, Minn.

[21] Appl. No.: 640,617

[22] Filed: Jan. 11, 1991

[51] Int. Cl.[5] ..... A47K 10/24

[52] U.S. Cl. ..... 221/51; 221/47; 221/48; 221/52; 221/305; 221/309

[58] Field of Search ..... 221/45, 46, 47, 48, 221/50, 51, 52, 55, 305, 309; 312/42, 50, 61

[56] References Cited

U.S. PATENT DOCUMENTS

| | | | |
|---|---|---|---|
| 1,072,859 | 9/1913 | Kingsley | 221/46 X |
| 2,082,765 | 6/1937 | Krueger | 221/45 |
| 3,265,241 | 8/1966 | McColgan | 221/47 |
| 3,986,479 | 10/1976 | Bonk | 221/47 X |
| 4,200,200 | 4/1980 | Hein et al. | 221/48 |
| 4,586,629 | 5/1986 | Loder | 221/46 |
| 4,586,630 | 5/1986 | Loder | 221/46 |
| 4,653,666 | 3/1987 | Mertens | 221/56 X |
| 4,735,317 | 4/1988 | Sussman et al. | 221/46 X |
| 4,781,306 | 11/1988 | Smith | 221/45 X |
| 4,877,154 | 10/1989 | Matsui | 221/48 |
| 4,993,590 | 2/1991 | Windorski | 221/45 X |

FOREIGN PATENT DOCUMENTS 186224 9/1936 Switzerland .

*Primary Examiner*—Robert P. Olszewski
*Assistant Examiner*—Dean A. Reichard
*Attorney, Agent, or Firm*—Gary L. Griswold; Walter N. Kirn; William L. Huebsch

[57] ABSTRACT

The combination of (1) sheets of note paper in a stack with each of the sheets having a narrow band of adhesive coated on its bottom surface along one edge by which the sheet is adhered to the top surface of the adjacent sheet in the stack, the sheets being stacked with the band of adhesive of adjacent sheets at alternate opposite sides of the stack, and (2) a dispenser comprising a housing closely receiving the top, bottom and first side surfaces of the stack of sheets. The housing includes a top wall of flexible material adjacent the top surface of the stack, which top wall has through flanking slits parallel to and flanking side surfaces of the stack and generally centered along those side surfaces, and spaced edge surfaces extending between the flanking slits. The flanking slits and edge surfaces define two opposed flap like portions of the top wall and a slot through the top wall between the flap like portion through which slot projects a portion of the uppermost sheet in the stack. When the uppermost sheet in the stack is withdrawn through the slot the flap like portion adjacent the band of adhesive on the uppermost sheet will flex away from the stack to form a convex arcuate surface adjacent the stack along which the sheet being withdrawn and the end of the second uppermost sheet in the stack to which the band of adhesive is adhered can slide to thereby restrict curling of the sheets, and the flap like portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

20 Claims, 3 Drawing Sheets

DISPENSER FOR A SMALL STACK OF NOTE PAPER

TECHNICAL FIELD

The present invention relates to dispensers for sheets of note paper disposed in a stack with each of the sheets having a narrow band of adhesive coated on one surface along one edge by which the sheets are adhered together and with the sheets being stacked with the band of adhesive of adjacent sheets at alternate opposite edges of the stack.

BACKGROUND ART

One dispenser for such sheets from such a stack is described in U.S. Pat. No. 4,416,392, assigned to the assignee of this application, wherein the stack of sheets is disposed in a box and the sheets can be withdrawn through a slot in the top of the box and centrally disposed parallel to the opposite edges of the sheets which are coated with the bands of adhesive. The box described in U.S. Pat. No. 4,416,392, however, provides no means for preventing the second sheet in the stack from being withdrawn with the first sheet in the stack in response to force applied to the first sheet to withdraw it. Thus, to separate the first sheet from the second after the first sheet is withdrawn from the box, the first sheet must be manually peeled from the second while manually holding the second sheet, which is inconvenient.

U.S. Pat. No. 4,416,392 also discloses a dispenser for such a stack of sheet material wherein a base is provided for supporting a removable cover within which is disposed the stack of sheet material. The cover is provided with an opening in its top wall and the stack of sheets are urged toward the top wall by a spring. The top wall is formed by two inclined portions which terminate at the dispensing opening. While the spring in this dispenser provides means for preventing the second sheet in the stack from being withdrawn with the first sheet in the stack in response to force applied to the first sheet to withdraw it due to the pressure the spring provides between the second sheet and the top wall, this dispenser comprises four basic parts to dispense the stack of sheets, and the sharp edges in the dispenser at the opening cause sheets that are dispensed to become stressed during the dispensing action about the edges of the opening so that the sheets retain a curl after they are dispensed.

U.S. Pat. No. 4,653,666, assigned to the assignee of this application, discloses a further embodiment of a dispenser for such a stack of sheets. This dispenser comprises a box which fits about the stack of sheets and has a centrally disposed opening transverse to the edges coated with the adhesive. A spring member in the box presses the stack of sheets toward the opening. Extending from the top wall of the box and into the opening are flexible polymeric flaps which during dispensing of the sheets bend to form convex arcuate surfaces about which the sheets are drawn as they are dispensed. This structure thus avoids the development of any curl in the dispensed sheets so that the sheets, after being dispensed and positioned on a receptor lay generally flat along the surface of the receptor and thus.are not as subject to becoming dislodged as they would be had a curl been present in the dispensed sheet. This dispenser, as noted however, comprises a number of parts.

U.S. Pat. No. 4,796,781, also assigned to the assignee of this application, describes a refillable dispenser for such a stack of sheets comprising a base part adapted to be supported on a horizontal support surface and to support the stack of sheets; and a body part having a bottom surface including spaced pressure surface portions adapted to engage and be supported on the upper surface of the stack adjacent the edges of the sheets along which the narrow bands of adhesive are coated with the spaced pressure surface portions engaging an upper surface of the sheets at predetermined distances from the edges of the sheets along which the narrow bands of adhesive are coated, and convex arcuate surface portions between the pressure surface portions and a top surface of the body part defining a slot through and extending centrally across the body part. The convex arcuate surface portions have radii having a dimension at least as great as the predetermined distances to restrict curling of sheets of paper pulled from the dispenser through the slot, and the body part has sufficient weight (e.g., about 0.5 to 1.5 pound) to afford pulling a sheet from the stack through the slot without substantially lifting the body part from the stack.

While the dispensers described in U.S. Pat. Nos. 4,653,666 and 4,796,781 are effective in allowing sheets to be withdrawn from the stack without either curling or wrinkling the sheets and without withdrawing the second sheet in the stack with the sheet being withdrawn, they are too expensive and complex for use with a stack containing a small number of sheets such as persons might want to carry with them, such as in their pockets, briefcases or purses.

DISCLOSURE OF INVENTION

The present invention provides a dispenser for a stack of sheets of the type described above that is effective in allowing sheets to be withdrawn from the stack without either curling or wrinkling the sheets, and without withdrawing the second sheet in the stack with the sheet being withdrawn, which dispenser is sufficiently simple and inexpensive for use with a stack containing a small number of sheets such as persons might want to carry with them in their pockets, briefcases or purses.

According to the present invention there is provided a combination of (1) a small number (e.g., less than 100) of similarly sized sheets of note paper disposed in alignment in a stack with each of the sheets having a narrow band of adhesive coated on its bottom surface along one edge by which the sheet is adhered to the top surface of the adjacent sheet in the stack, the sheets being stacked with the band of adhesive of adjacent sheets at alternate opposite sides of the stack, the stack having first side surfaces at said alternate opposite sides of the stack, having second side surfaces disposed in a direction at a right angle to the first side surfaces of the stack, a top surface defined by the top surface of the uppermost sheet in the stack, and an opposite bottom surface; and (2) a dispenser comprising a housing having inner surfaces defining a cavity closely receiving the top, bottom and first side surfaces of the stack of sheets. The housing includes a top wall of flexible material adjacent the top surface of the stack, which top wall has through, flanking slits (e.g., in the range of 1.27 to 3.18 centimeter or 0.5 to 1.25 inches long) parallel to and flanking the second side surfaces of the stack and generally centered between the first side surfaces of the stack, and spaced edge surfaces extending between the flanking slits. The flanking slits and edge surfaces define two opposed flap like portions of the top wall and a slot through the top wall between the flap like portion through which slot projects an end portion of the uppermost sheet in the stack, the edge surfaces having central portions spaced from each other by a dimension in the range of 0.6 to 1.9 centimeter (0.25 to 0.75 inch) so that when the uppermost sheet in the stack is withdrawn through the slot the flap like portion adjacent the band of adhesive on the uppermost sheet will flex away from the stack to form a convex arcuate surface adjacent the stack along which the sheet being withdrawn and the end of the second uppermost sheet in the stack to which the band of adhesive is adhered can slide to thereby restrict curling of the sheets, and the flap like portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

In one embodiment specifically intended for no more than about 100 sheets in the stack, and preferably for 50 sheets or less, the entire housing is of 0.030 centimeter (0.012 inch) thick card stock material, the edge surfaces have outer portions diverging from their central portions toward the adjacent ends of said slits, the flanking slits are about 2.54 centimeter (1 inch) long, and the central portions of said edge surfaces are spaced from each other by about 0.95 centimeter (0.375 inch). In this embodiment the housing can include a main portion defining the cavity in which the stack of sheets is contained, and a cover portion which is pivotably mounted on the main portion for movement between a closed position along the top wall, and an open position spaced from said top wall, with the main and cover portions including means for releasably retaining the cover portion in its closed position so that the housing can be carried in a pocket, briefcase or purse without damaging the end portion of the top sheet in the stack that projects through the slot.

Other embodiments can be made that efficiently dispense more than 50 sheets by (1) attaching a pad of resiliently flexible material having a high coefficient of friction with the sheets relative to the top wall material to the surfaces of the flap like portions adjacent the stack which pad adds drag between the flap like portions and the sheets being withdrawn thereby placing drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot, or (2) adding a resiliently flexible member between the bottom wall of the housing and the bottom surface of the stack extending transversely between the second side surfaces of the stack opposite the slot to arch the stack about an axis parallel to the edge surfaces and press the portion of the stack adjacent the flap like portions against the top wall which reduces the force needed to withdraw a sheet from the stack through the slot and the tendency to curl or wrinkle sheets being withdrawn compared to the same stack in the same housing without the resiliently flexible member so that the stack is not arched.

BRIEF DESCRIPTION OF DRAWING

The present invention will be further described with reference to the accompanying drawing wherein like reference numerals refer to like parts in the several views, and wherein.

DETAILED DESCRIPTION

Figure 2:
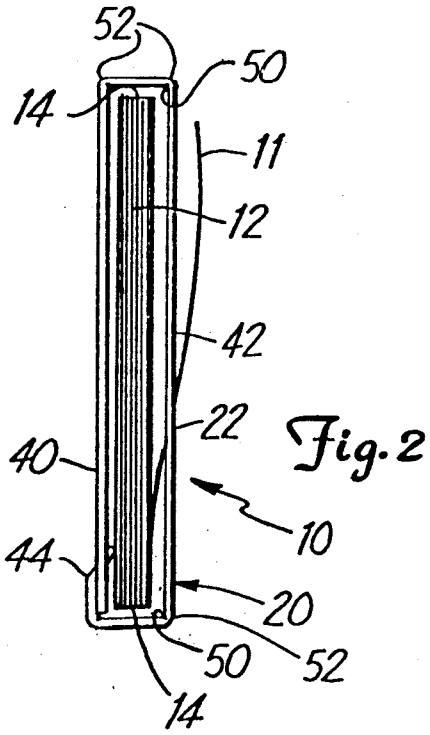
FIG. 2 is a side view of the combination of FIG. 1 shown with the cover portion of the dispenser in a closed position.
Figure 1:
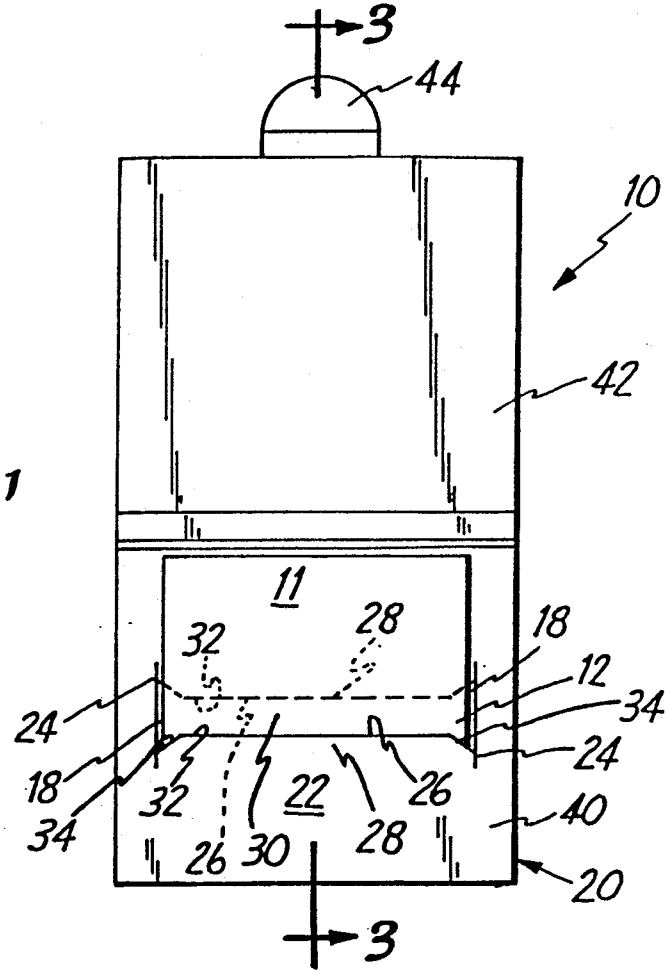
FIG. 1 is a plan view of a first embodiment of a combination according to the present invention comprising a stack of sheets and a dispenser containing the stack shown with a cover portion of the dispenser in an open position.

Referring now to FIGS. 1 through 6 of the drawing, there is illustrated a first embodiment of a combination 10 according to the present invention of (1) no more than about 100 similarly sized sheets 11 of note paper (e.g., each 7 centimeter by 7.6 centimeter (2.75 inch by 3 inch) although many other sizes could also be used) disposed in alignment in a stack 12 with each of the sheets 11 having top and bottom surfaces and a narrow band of adhesive 14 coated on the bottom surface along one edge by which the sheet 11 is adhered to the top surface of the adjacent sheet 11 in the stack 12, the sheets 11 being stacked with the bands of adhesive 14 of adjacent sheets 11 at alternate opposite sides of the stack 12, the stack 12 having first side surfaces 16 at the alternate opposite sides of the stack 12, having second side surfaces 18 disposed in a direction at a right angle to the first side surfaces 16, a top surface defined by the top surface of the uppermost sheet in the stack 12, and an opposite bottom surface; and (2) a dispenser comprising a housing 20 having inner surfaces defining a cavity closely receiving the top, bottom and first side surfaces 16 of the stack 12 of sheets 11. The housing 20 is entirely of folded card stock and includes a top wall 22 of that flexible material adjacent the top surface of the stack 12. The top wall 22 has through flanking slits 24 in the range of 1.27 to 3.18 centimeter (0.5 to 1.25 inch) long and preferably 2.54 centimeter (1 inch) long parallel to and flanking the second side surfaces 18 of the stack 12 and generally centered between the first side surfaces 16 of the stack 12, spaced edge surfaces 26 extending between the flanking slits 24, the flanking slits 24 and edge surfaces 26 defining two opposed flap like portions 28 of the top wall 22 and a slot 30 through the top wall 22 between the flap like portions 28 through which slot 30 projects a portion of the uppermost sheet 11 in the stack 12. The edge surfaces 26 have straight parallel central portions 32 spaced from each other by a dimension in the range of 0.6 to 1.9 centimeter (0.25 to 0.75 inch) and preferably 0.95 centimeter (0.375 inch) so that when the uppermost sheet 11 in the stack 12 is withdrawn through the slot 30 the flap like portion 28 adjacent the band of adhesive 14 on the uppermost sheet 11 will flex away from the stack 12 to form a convex arcuate surface (see FIG. 4) adjacent the stack 12 along which the sheet 11 being withdrawn and the end of the second uppermost sheet 11 in the stack 12 to which the band of adhesive 14 is adhered can slide to thereby restrict curling of the sheets 11, and the flap like portion 28 opposite the band of adhesive 14 on the withdrawn uppermost sheet 11 will place drag on the second uppermost sheet 11 in the stack 12 (see FIG. 5) so that the force applied to withdraw the uppermost sheet 11 will peel the uppermost sheet 11 away from the end of the second uppermost sheet 11 in the stack 12 after it is withdrawn through the slot 30 rather than fully withdrawing the second sheet 12 through the slot 30. The edge surfaces 26 also have outer portions 34 diverging from the ends of the central portions 32 toward the adjacent ends of the flanking slits 24 that intersect the flanking slits 24 at a location spaced from their ends (e.g., spaced by about 0.33 centimeter (0.13 inch) from their ends) and which each intersect the central portions 32 at a dimension in the range of about 0.125 to 0.5 inch from the flanking slits 24. The outer portions 34 of the edge surfaces 26 are illustrated as being straight, but alternatively could have arcuate shapes.

The housing 20 includes a main portion 40 defining the cavity in which the stack 12 is received, and a cover portion 42 adapted to overlay the top wall 22 and pivotably mounted on the main portion 40 for movement between a closed position along the top wall 22, and an open position spaced from the top wall 22. The main and cover portions 40 and 42 including means in the form of a tab 44 projecting from the cover portion 42 adapted to engage a slot 46 in the main portion 40 for releasably retaining the cover portion 42 in its closed position.

The dimension between the inner surfaces of the top wall 22 and the bottom wall of the housing 20 is about the same as the height dimension of the stack 12 (e.g., about 0.187 inch for a 50 sheet stack 12). The dimension between the inner surfaces of the walls of the housing 20 adjacent the first side surfaces 16 should be about 0.062 inch greater than the dimension between the first side surfaces 16 to provide a slight clearance therebetween.

Figure 6:
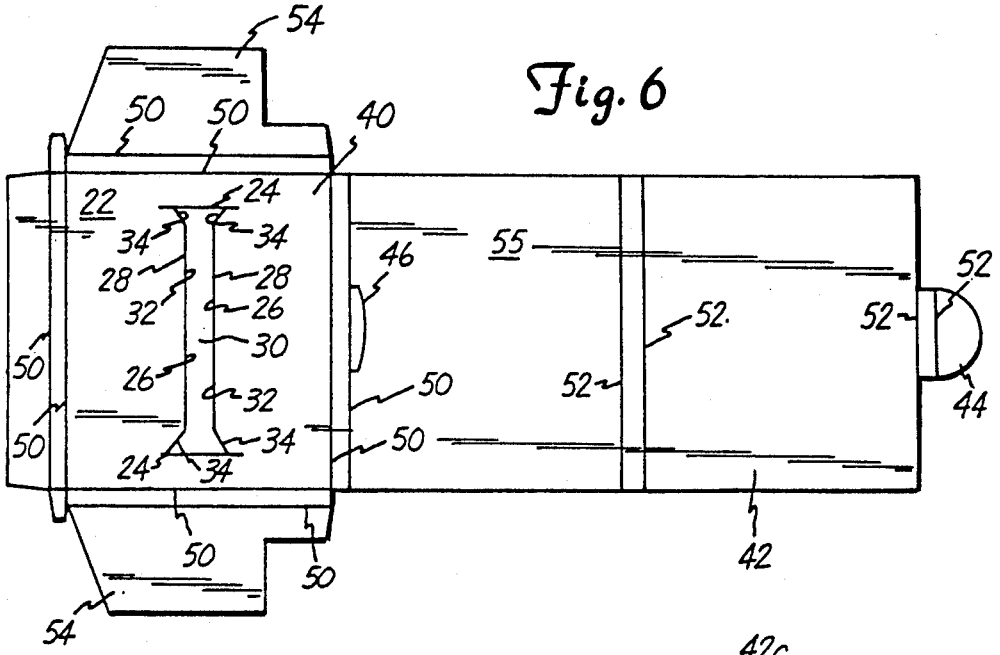
FIG. 6 is a view of a sheet from which the dispenser included in the combination of FIG. 1 is made shown before it is folded and adhered together to form the dispenser.

The housing 20 is made from one piece of card stock shaped as is shown in FIG. 6, creased along lines 50 and 52, permanently folded around the stack 12 of sheets 11 along the crease lines 50 so that the portion thereof providing the top wall 22 is adjacent its top surface, the portions 52 thereof are adjacent the side surfaces 16 and 18 of the stack 12, attachment potions 54 thereof are adhered to a rectangular portion 55 thereof as by adhesive to form the bottom wall of the housing 20, whereupon the housing 20 may be bent along the crease lines 52 so that the cover portion 42 can move from its open to its closed positions, and the tab 44 may be inserted in the slot 46 to retain the cover portion 42 in its closed position.

Figure 7:
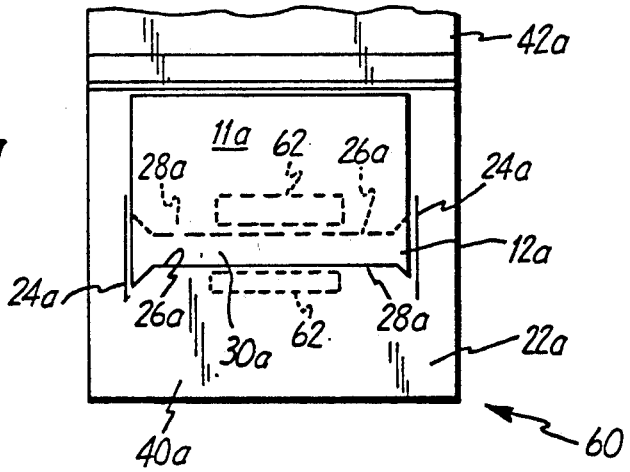
FIG. 7 is a fragmentary plan view of a second embodiment of a combination according to the present invention comprising a stack of sheets and a dispenser containing the stack.

Referring now to FIG. 7 of the drawing, there is illustrated a second embodiment of a combination 60 according to the present invention which is essentially the same in structure as the combination 10 illustrated in FIGS. 1 through 6 (and which has similar parts numbered with similar reference numerals except for the addition of the suffix "a"), except that the combination 60 can properly dispense sheets from a stack **12*a* including more that 50 sheets 11*a* due to the addition of pads 62 of resiliently flexible material (e.g., 0.24 centimeter thick, 2.54 centimeter long by 0.64 centimeter wide pad 62 of natural foam rubber) having a high coefficient of friction with the sheets 11 relative to the card stock top wall 22*a* material. The pads 62 add drag between the flap like portions 28*a* and the sheets 11*a* being withdrawn, thereby placing drag on the second uppermost sheet 11*a* in the stack 12*a* so that the force applied to withdraw the uppermost sheet 11*a* will peel the uppermost sheet 11*a* away from the end of the second uppermost sheet 11*a* in the stack 12*a* after it is withdrawn through the slot 30*a* rather than fully withdrawing the second sheet 11*a* through the slot 30*a***.

Figure 8:
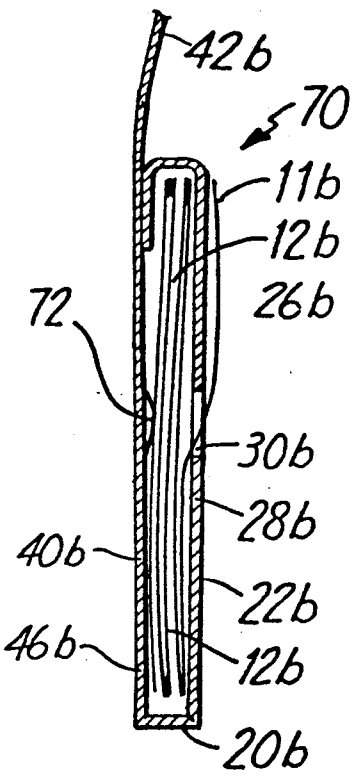
FIG. 8 is a fragmentary sectional view of a third embodiment of a combination according to the present invention comprising a stack of sheets and a dispenser containing the stack.
Figure 5:
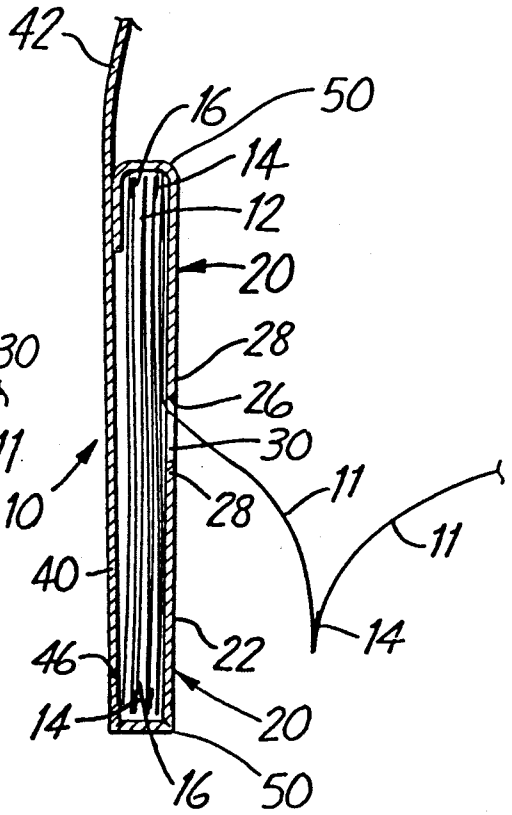
FIGS. 4 and 5 are fragmentary sectional views which sequentially illustrate a sheet being dispensed from the dispenser.
Figure 4:
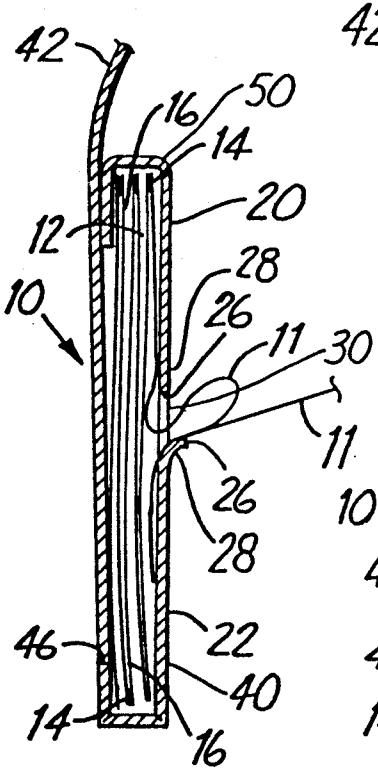
Figure 3:
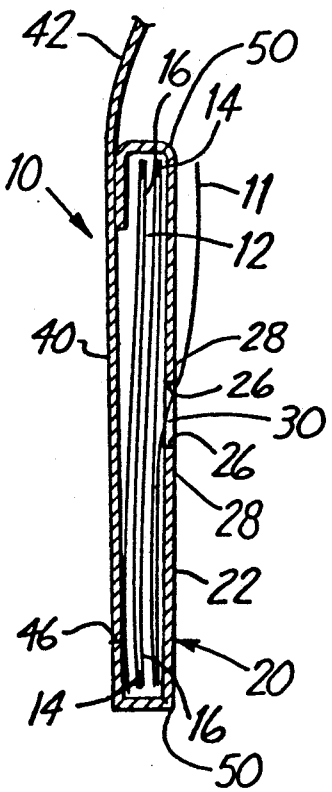
FIG. 3 is an enlarged fragmentary sectional view taken approximately along line 3—3 of FIG. 1.

Referring now to FIG. 8 of the drawing, there is illustrated a third embodiment of a combination 70 according to the present invention which is essentially the same in structure as the combination 10 illustrated in FIGS. 1 through 6 (and which has similar parts numbered with similar reference numerals except for the addition of the suffix "*b*"), except that the combination 70 can properly dispense sheets from a stack **12*b* including up to and more that 50 sheets 11*b* due to the addition of a resiliently flexible member 72 between the bottom wall of the housing 20*b* and the bottom surface of the stack 12*b*, which flexible member 72 extends between the second side surfaces 18*b* of the stack 12*b* opposite the slot 30*b* to arch the stack 12*b* about an axis parallel to the edge surfaces 26*b* and press the portion of the stack 12*b* adjacent the flap like portions 28*b* against the top wall 22*b* which reduces the force needed to withdraw a sheet 11*b* from the stack 12*b* through the slot 30*b* and the tendency to curl or wrinkle sheets 11*b* being withdrawn compared to the same stack 12*b* in the same housing 40*b* without the resiliently flexible member 72 so that the stack 12*b* is not arched. As illustrated the flexible member 72 is a portion of the folded card stock housing 20*b* bent into generally a U shape and having one end of the U shaped flexible member 72** attached to the bottom wall, and its other end unattached.

If desired, the additions illustrated in FIGS. 7 and 8 can both be used in one housing to provide a combination with better dispensing properties for a stack including a large number of sheets than does either addition alone.

Figure 9:
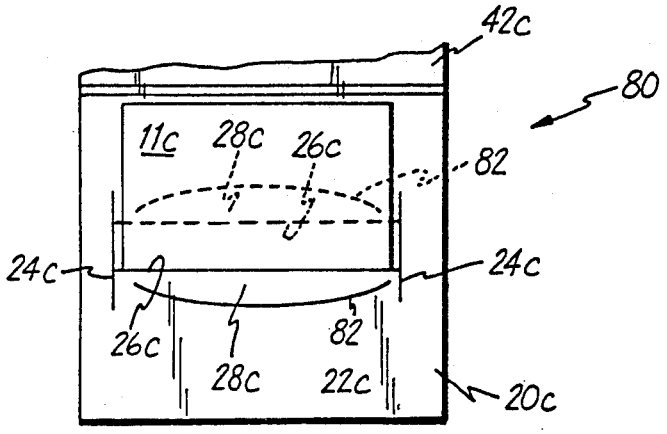
FIG. 9 is a fragmentary plan view of a fourth embodiment of a combination according to the present invention comprising a stack of sheets and a dispenser containing the stack.

Referring now to FIG. 9 of the drawing, there is illustrated a fourth embodiment of a combination 80 according to the present invention which is essentially the same in structure as the combination 10 illustrated in FIGS. 1 through 6 (and which has similar parts numbered with similar reference numerals except for the addition of the suffix "*c*"), except that the flap like portions **28*c* in the housing 20*c* each have through arcuate cuts 82 extending partially along and spaced from the edge surfaces 26*c* to increase the flexibility of portions of the flap like portions 28*c*. The ends of the cuts 82 are spaced closer to the edge surfaces 26*c* than the centers of the cuts 82, and the edge surfaces 26*c* extend in a straight line between the flanking slits 24*c*. The arcuate slots 82 through and extending along the flap like portions 28*c* facilitate arching of portions of the flap like portions 28*c* when sheets 11*c* are withdrawn through the slot to help restrict tearing or curling of the sheets 11*c***.

The present invention has now been described with reference to four embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. In combination:

no more than about 100 similarly sized sheets of note paper disposed in alignment in a stack with each of the sheets having top and bottom surfaces and a narrow band of adhesive coated on said bottom surface along one edge by which the sheet is adhered to the top surface of the adjacent sheet in the stack, the sheets being stacked with the band of adhesive of adjacent sheets at alternate opposite sides of the stack, said stack having first side surfaces at said alternate opposite sides of the stack, having second side surfaces disposed in a direction at a right angle to said first side surfaces, a top surface defined by the top surface of the uppermost sheet in the stack, and an opposite bottom surface; and a dispenser comprising a housing having inner surfaces defining a cavity closely receiving the top, bottom and first side surfaces of said stack of sheets, said housing including a top wall comprising a single layer of flexible material adjacent the top surface of the stack, said single layer having through flanking slits in the range of 1.27 to 3.18 centimeter (0.5 to 1.25 inch) long parallel to and flanking the second side surfaces of the stack and generally centered between the first side surfaces of the stack, spaced edge surfaces extending between said flanking slits, said flanking slits and edge surfaces defining two opposed flap like portions of said single layer and a slot through the top wall between said flap like portions through which slot projects a portion of the uppermost sheet in the stack, said edge surfaces having central portions spaced from each other by a dimension in the range of 0.6 to 1.9 centimeter (0.25 to 0.75 inch) so that when the uppermost sheet in the stack is withdrawn through the slot the flap like portion adjacent the ban of adhesive on the uppermost sheet will flex away from the stack to form a convex arcuate surface adjacent the stack along which the sheet being withdrawn and the end of the second uppermost sheet in the stack to which the band of adhesive is adhered can slide to thereby restrict curling of the sheets, and the flap like portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

2. A combination according to claim 1 wherein said edge surfaces have outer portions diverging from said central portions toward the adjacent ends of said slits.

3. A combination according to claim 1 wherein said edge surfaces have outer portions diverging from said central portions toward the adjacent ends of said slits, said flanking slits are about 2.54 centimeters (1 inch) long and said central portions of said edge surfaces are spaced from each other by about 0.95 centimeter (0.375 inch).

4. A combination according to claim 1 wherein said single layer is of 0.030 centimeter (0.012 inch) thick card stock material, said edge surfaces have outer portions diverging from said central portions toward the adjacent ends of said slits, said flanking slits are about 2.54 centimeters (1 inch) long, and said central portions of said edge surfaces are spaced from each other by about 0.95 centimeter (0.375 inch).

5. A combination according to claim 1 wherein said entire housing is of card stock material.

6. A combination according to claim 1 wherein said entire housing is of card stock material, and said housing includes a main portion defining said cavity, and a cover portion adapted to overlay said top wall and pivotably mounted on said main portion for movement between a closed position along said top wall, and an open position spaced from said top wall, said main and cover portions including means for releasably retaining said cover portion in said closed position.

7. In combination:

a multiplicity of similarly sized sheets of note paper disposed in alignment in a stack with each of the sheets having top and bottom surfaces and a narrow band of adhesive coated on said bottom surface along one edge by which the sheet is adhered to the top surface of the adjacent sheet in the stack, the sheets being stacked with the band of adhesive of adjacent sheets at alternate opposite sides of the stack, the end of the second uppermost sheet in the stack after it is withdrawn through the slot rather than fully withdrawing the second sheet through the slot.

8. A combination according to claim 7 wherein said edge surfaces have outer portions diverging from said central portions toward the adjacent ends of said slits.

9. A combination according to claim 7 wherein said edge surfaces have outer portions diverging from said central portions toward the adjacent ends of said slits, and said flanking slits are in the range of about 1.27 to 3.18 centimeter (0.5 to 1.25 inch) long.

10. A combination according to claim 7 wherein said single layer is of 0.030 centimeter (0.012 inch) thick card stock, said edge surfaces have outer portions diverging from said central portions toward the adjacent ends of said slits, said flanking slits are about 2.54 centimeters (1 inch) long and said central portions of said edge surfaces are spaced from each other by about 0.95 centimeter (0.375 inch).

11. A combination according to claim 7 wherein said entire housing is of card stock.

12. A combination according to claim 7 wherein said entire housing is of card stock, and said housing includes a main portion defining said cavity, and a cover portion adapted to overlay said top wall and pivotably mounted on said main portion for movement between a closed position along said top wall, and an open position spaced from said top wall, said main and cover portions including means for releasably retaining said cover portion in said closed position.

13. In combination:

a multiplicity of similarly sized sheets of note paper disposed in alignment in a stack with each of the sheets having top and bottom surfaces and a narrow band of adhesive coated on said bottom surface along one edge by which the sheet is adhered to the top surface of the adjacent sheet in the stack, the sheets being stacked with the band of adhesive of adjacent sheets at alternate opposite sides of the stack, said stack having first side surfaces at said alternate opposite sides of the stack, having second side surfaces disposed in a direction at a right angle to said first side surfaces, a top surface defined by the top surface of the uppermost sheet in the stack, and an opposite bottom surface; and a dispenser comprising a housing having inner surfaces defining a cavity closely receiving the top, bottom and first side surfaces of said stack of sheets, said housing including a top wall comprising a single layer of flexible material adjacent the top surface of the stack, and a bottom wall adjacent the bottom surface of the stack, said single layer having through flanking slits in the range of 1.27 to 3.18 centimeter (0.5 to 1.25 inch) long parallel to and flanking the second side surfaces of the stack and generally centered between the first side surfaces of the stack, spaced edge surfaces extending between said flanking slits, said flanking slits and edge surfaces defining two opposed flap like portions of said single layer and a slot through the top wall between said flap like portions through which slot projects a portion of the uppermost sheet in the stack, said edge surfaces having central portions spaced from each other by a dimension in the range of 0.6 to 1.9 centimeter (0.25 to 0.75 inch) so that when the uppermost sheet in the stack is withdrawn through the slot the flap like portion adjacent the band of adhesive on the uppermost sheet will flex away from the stack to form a convex arcuate surface adjacent the stack along which the sheet being withdrawn and the end of the second uppermost sheet in the stack to which the band of adhesive is adhered can slide to thereby restrict curling of the sheets, and the flap like portion opposite the ban of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot; and a resiliently flexible member between said bottom wall of said housing and the bottom surface of said stack extending between said second side surfaces of said stack opposite said slot to arch said stack about an axis parallel to said edge surfaces.

14. A combination according to claim 13 wherein said edge surfaces have outer portions diverging from said central portions toward the adjacent ends of said slits.

15. A combination according to claim 13 wherein said edge surfaces have straight outer portions diverging from said central portions toward the adjacent ends of said slits.

16. A combination according to claim 13 wherein said top wall is of 0.030 centimeter (0.012 inch) thick card stock, said edge surfaces have outer portions diverging from said central portions toward the adjacent ends of said slits, said flanking slits are about 2.54 centimeter (1 inch) long and said central portions of said edge surfaces are spaced from each other by about 0.953 centimeter (0.375 inch).

17. A combination according to claim 13 wherein said entire housing is of card stock, and said resiliently flexible member between said bottom wall of said housing and the bottom surface of said stack is a folded portion of said housing projecting from said bottom wall.

18. A combination according to claim 13 wherein said entire housing is of card stock, and said housing includes a main portion defining said cavity, and a cover portion adapted to overlay said top wall and pivotably mounted on said main portion for movement between a closed position along said top wall, and an open position spaced from said top wall, said main and cover portions including means for releasably retaining said cover portion in said closed position.

19. A combination according to claim 13 further including a pad of resiliently flexible material having a high coefficient of friction with said sheets relative to said top wall material attached to the surface of each flap like portion adjacent said stack.

20. A combination according to claim 1 wherein said flap like portions each having through arcuate cuts extending partially along and spaced from said edge surfaces to increase the flexibility of parts of said flap like portions.

* * * * *

UNITED STATES PATENT AND TRADEMARK OFFICE

CERTIFICATE OF CORRECTION

PATENT NO. : 5,158,205
DATED : October 27, 1992
INVENTOR(S) : Bodziak et al.

It is certified that error appears in the above-indentified patent and that said Letters Patent is hereby corrected as shown below:

Col. 2, line 61, "through," should be --through--.

Col. 2, line 63, "inches long)"
should be --inches) long--.

Claim 7 line 10, after "stack"
insert --said stack having first side surfaces at said alternate opposite sides of the stack, having second side surfaces disposed in a direction at a right angle to said first side surfaces, a top surface defined by the top surface of the uppermost sheet in the stack, and an opposite bottom surface;

a dispenser comprising a housing having inner surfaces defining a cavity closely receiving the top, bottom and first side surfaces of said stack of sheets, said housing including a top wall comprising a single layer of flexible material adjacent the top surface

UNITED STATES PATENT AND TRADEMARK OFFICE

CERTIFICATE OF CORRECTION

PATENT NO. : 5,158,205
DATED : October 27, 1992
INVENTOR(S) : Bodziak et al.

It is certified that error appears in the above-indentified patent and that said Letters Patent is hereby corrected as shown below:

of the stack, said single layer having through flanking slits parallel to and flanking the second side surfaces of the stack and generally centered between the first side surfaces of the stack, and spaced edge surfaces extending between said flanking slits, said spaced edge surfaces and said flanking slits defining two opposed flap like portions of said single layer and a slot through the top wall between said flap like portions through which slot projects a portion of the uppermost sheet in the stack, said edge surfaces having central portions spaced from each other by a demension in the range of 0.6 to 1.9 centimeter (0.25 to 0.75 inch; and

UNITED STATES PATENT AND TRADEMARK OFFICE

CERTIFICATE OF CORRECTION

PATENT NO. : 5,158,205

DATED : October 27, 1992

INVENTOR(S) : Bodziak, et al.

It is certified that error appears in the above-indentified patent and that said Letters Patent is hereby corrected as shown below:

a pad of resiliently flexible material having a high coefficient of friction with said sheets relative to the material of said single layer attached to the surface of each flap portion adjacent said stack so that when the uppermost sheet in the stack is withdrawn through the slot the flap like portion adjacent the band of adhesive on the uppermost sheet will flex away from the stack to form on the flap like portion and the pad attached thereto a convex arcuate surface adjacent the stack along which the sheet being withdrawn and the end of the second uppermost sheet in the stack to which the band of adhesive is adhered can slide to thereby restrict curling of the sheets, and the flap like portion and the pad attached thereto opposite the band of adhesive on the withdrawn uppermost sheet will place drag on the second uppermost sheet in the stack so that the force applied to withdraw the uppermost sheet will peel the uppermost sheet away from--.

Signed and Sealed this

Thirtieth Day of May, 1995

*Attest:*

Bruce Lehman

BRUCE LEHMAN

*Attesting Officer*

*Commissioner of Patents and Trademarks*